US011723424B2

(12) United States Patent
Skurla, III

(10) Patent No.: US 11,723,424 B2
(45) Date of Patent: Aug. 15, 2023

(54) INSULATED PANELING FOR ACTIVE SPORTS

(71) Applicant: Acushnet Company, Fairhaven, MA (US)

(72) Inventor: Peter J. Skurla, III, Bridgewater, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/241,445

(22) Filed: Apr. 27, 2021

(65) Prior Publication Data

US 2022/0338576 A1 Oct. 27, 2022

(51) Int. Cl.

| | |
|---|---|
| ***A41D 31/06*** | (2019.01) |
| ***A41D 1/02*** | (2006.01) |
| ***D06J 1/00*** | (2006.01) |
| ***A41D 13/00*** | (2006.01) |

(52) U.S. Cl.

CPC ..... *A41D 31/065* (2019.02); *A41D 1/02* (2013.01); *D06J 1/00* (2013.01); *A41D 13/0015* (2013.01); *A41D 2400/10* (2013.01); *A41D 2600/10* (2013.01); *D05D 2209/00* (2013.01); *D05D 2303/00* (2013.01); *D05D 2305/00* (2013.01)

(58) Field of Classification Search

CPC ... A41D 1/00; A41D 1/02; A41D 1/04; A41D 1/10; A41D 3/00; A41D 3/02; A41D 13/00; A41D 13/0015; A41D 13/002; A41D 15/00; A41D 15/002; A41D 19/00; A41D 19/0006; A41D 19/015; A41D 19/01529; A41D 27/24; A41D 31/06; A41D 31/065; A41D 31/18; A41D 31/185; A41D 2300/50; A41D 2400/10; A41D 2600/10; D06J 1/00; D05D 2209/00; D05D 2303/00; D05D 2305/00; D05D 2305/02; D05D 2305/04; D05D 2305/06

USPC ..... 2/243.1, 97, 93, 2.16, 458; 5/413 R; 112/420, 427

See application file for complete search history.

(56) References Cited

U.S. PATENT DOCUMENTS

| | | | | |
|---|---|---|---|---|
| 385,306 A | | 6/1888 | Helwitz | |
| 1,177,952 A | * | 4/1916 | Inman | A41D 1/02 2/93 |
| D119,122 S | | 2/1940 | Bauer | |
| 2,631,290 A | | 3/1953 | Klepper | |

(Continued)

FOREIGN PATENT DOCUMENTS

| | | |
|---|---|---|
| JP | 2014-139352 A | 7/2014 |
| WO | 2017/106667 A1 | 6/2017 |

OTHER PUBLICATIONS

European Search Report for EP Application No. 22 17 0275 dated Sep. 26, 2022 (7 pages).

*Primary Examiner* — Heather Mangine
*Assistant Examiner* — Matthew R Marchewka

(57) ABSTRACT

An active-insulation paneling component and garments including an active-insulation paneling component are disclosed. The active-insulation paneling component includes insulated panels separated by gussets. The gussets are configured to expand upon an outward pulling force to allow the active-insulation paneling component and/or garment to expand even where the active-insulation paneling component and/or garment are not manufactured from elastic materials.

20 Claims, 13 Drawing Sheets

(56) References Cited

U.S. PATENT DOCUMENTS

| | | | | |
|---|---|---|---|---|
| 5,657,497 | A * | 8/1997 | Howe | A47G 9/086 5/413 R |
| 6,279,161 | B1 * | 8/2001 | Johnston | A41D 13/0015 2/69 |
| 3,001,618 | A1 | 8/2011 | Bay | |
| 8,904,563 | B2 | 12/2014 | Lambertz | |
| 9,012,003 | B2 | 4/2015 | Harward | |
| 9,603,398 | B2 | 3/2017 | Hines et al. | |
| D800,425 | S | 10/2017 | Schneider | |
| 9,867,411 | B2 | 1/2018 | Gallagher | |
| 10,143,249 | B2 | 12/2018 | West | |
| 10,238,157 | B2 | 3/2019 | Nordstrom | |
| 10,244,804 | B2 | 4/2019 | Hodgson | |
| 2009/0077710 | A1 | 3/2009 | Bay | |
| 2014/0250596 | A1 * | 9/2014 | De La Place | A47G 9/0207 5/482 |
| 2014/0366239 | A1 * | 12/2014 | Biller | A41D 15/00 2/69.5 |
| 2015/0290901 | A1 * | 10/2015 | Banowit | B32B 7/05 5/413 R |
| 2018/0289090 | A1 | 10/2018 | Turner | |
| 2019/0084699 | A1 * | 3/2019 | Folcarelli | B65B 1/04 |
| 2020/0009828 | A1 * | 1/2020 | Ly | B32B 5/022 |
| 2020/0060366 | A1 * | 2/2020 | Selwyn | D06M 15/263 |
| 2020/0138134 | A1 * | 5/2020 | McMahon | A41D 3/02 |
| 2021/0085006 | A1 * | 3/2021 | Patton | A47G 9/086 |
| 2021/0112896 | A1 * | 4/2021 | Gore | A41D 31/065 |
| 2021/0392980 | A1 * | 12/2021 | Vaughn | A41D 31/06 |

* cited by examiner

INSULATED PANELING FOR ACTIVE SPORTS

BACKGROUND

Active sports that require physical movement from athletes may take place in a variety of environmental conditions. For example, winter sports, like skiing, curling, and skating, may be played indoors or outdoors in cold climates or seasons. Traditional summer sports, such as golf, may also be played in cold temperatures. Due to the cold temperatures, athletes may desire to wear additional garments, such as jackets, gloves, and/or insulated pants. Many of these garments may be insulated to provide warmth to the athletes while participating in their activities.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

The technology generally relates to insulated paneling for, and in, garments that allows for the garment both to expand with movement of the athlete and concurrently keep the athlete warm. In an aspect, the technology relates to a method of manufacturing an active-insulation paneling component for incorporation into a garment. The method includes applying formation stitch lines to partially join two fabric layers together, wherein the formation stitch lines define insulation-panel-formation sections and gusset-formation sections located between the insulation-panel-formation sections. The method further includes filling the insulation-panel-formation sections with insulation and folding the gusset-formation sections to bring borders of adjacent insulation-panel-formation sections together. The method also includes applying, substantially orthogonal to the formation stitch lines, at least one finishing stitch line to seal the insulation-panel-formation sections and fix the folds of the gusset-formation sections to form the active-insulation paneling component, wherein the active-insulation paneling component is configured to expand when a pulling force is applied in a direction orthogonal to the formation stitch lines.

In an example, the two fabric layers are made from an inelastic material having a weight less than or equal to 50 grams per square meter (gsm). In another example, the insulation is blown-in insulation. In a further example, the insulation-panel-formation sections have a width (D3), the gusset-formation sections have a width (D4), the widths D3 and D4 satisfy the inequality D3>2*D4. In yet another example, each gusset-formation section includes a central stitch line, and the folding operation is performed along the central stitch line. In still another example, folding the gusset-formation sections causes the borders of the adjacent insulation-panel-formation sections to partially overlap. In still yet another example, the method further includes joining the active-insulation paneling component to a garment, wherein the garment is one of a jacket, pants, a glove, or a shoe.

In another aspect, the technology relates to an active-insulation paneling component for incorporation into a garment. The active-insulation paneling component includes a first insulated panel filled with insulation; a second insulated panel filled with insulation; and a first gusset located between, and attached to, the first insulated panel and the second insulated panel, wherein the first gusset is configured to expand upon a pulling force pulling the first insulated panel apart from the second insulated panel.

In an example, a border of the first insulated panel is joined with a border of the second insulated panel at two or more positions. In another example, the borders are joined with a continuous finishing stitch line running through the first insulated panel and second insulated panel. In a further example, external surfaces of the first insulated panel, the second insulated panel, and the first gusset are formed from two sheets of material. In yet another example, the active-insulation paneling component includes a third insulated panel filled with insulation and a second gusset located between the second insulated panel and the third insulated panel. In still another example, a border of the third insulated panel overlaps a border of the second insulated panel. In still yet another example, the active-insulation paneling component further includes a binding around a perimeter of the active-insulation paneling component.

In another aspect, the technology relates to a jacket. The jacket includes a torso portion having a front side and a back side, the torso portion including a plurality of insulated segments; a right sleeve attached to the torso portion; a left sleeve attached to the torso portion; and an active-insulation paneling component incorporated into the back side of the torso portion, wherein the active-insulation paneling component includes alternating insulated panels and gussets.

In an example, the active-insulation paneling component is configured to expand upon application of a pulling force due to movement of at least one of the right sleeve or the left sleeve. In another example, a bottom edge of the active-insulation paneling component is curved as is attached to the torso portion with a curved stitch line. In a further example, an average radius of curvature of the curved stitch line is between 10 and 30 inches. In yet another example, a minimum length for any of the insulated panels is at least one-fourth a length of the jacket measured from a top of a collar to a bottom of the jacket. In still another example, the jacket further includes an elastic band attached to one or more gussets. This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

DETAILED DESCRIPTION

Figure 1A:
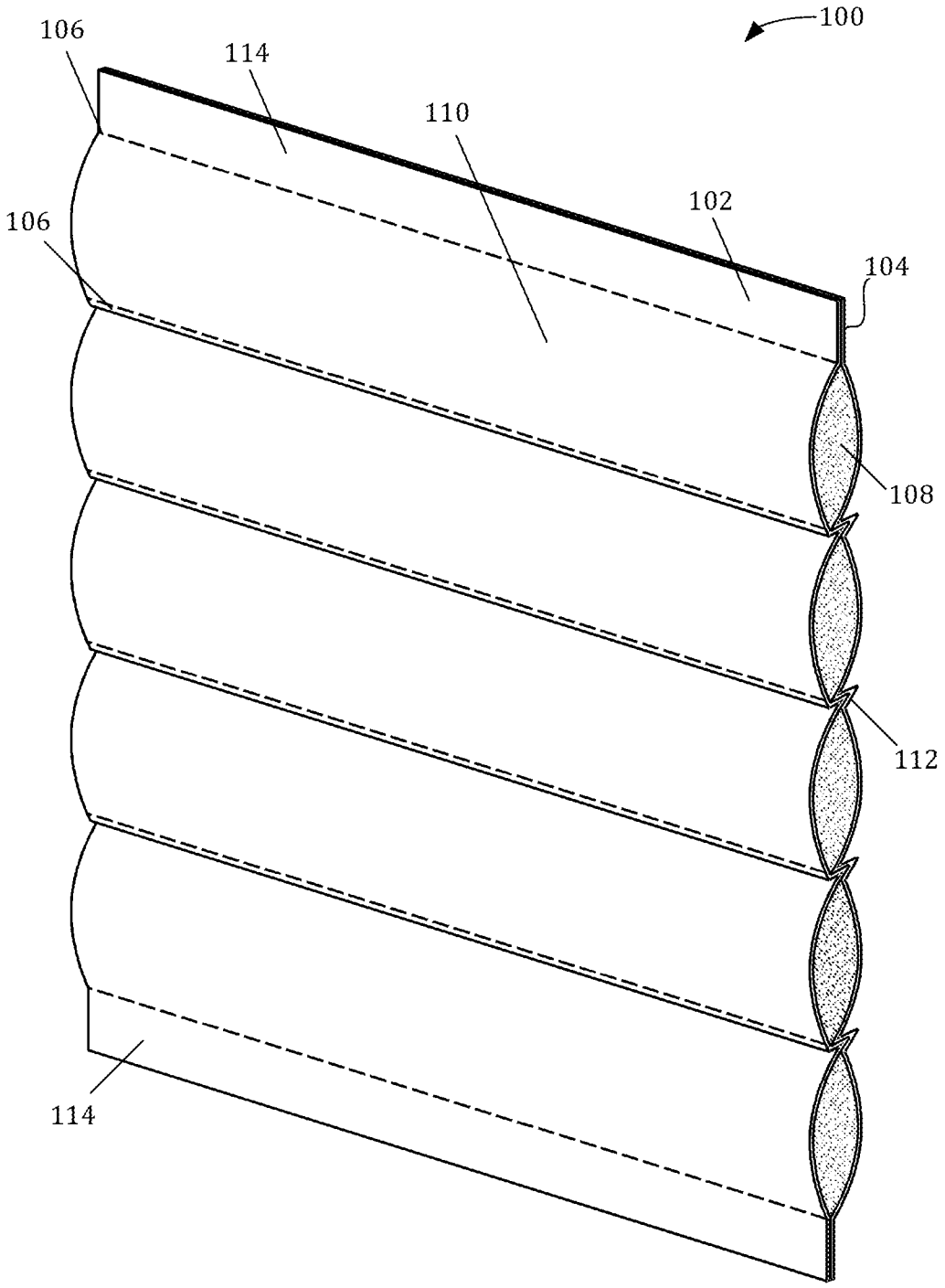
FIG. 1A depicts a perspective view of an example active-insulation paneling component.

As briefly discussed above, athletes participating in sports in cool or cold temperatures may desire to wear garments, such as jackets, gloves, shoes, boots, and/or insulated pants, to stay warm. While current garments may be insulated to help the athlete stay warm, the garments are often restrictive and limit the range of motion of the athlete. For instance, in the case of an insulated jacket, the jackets are made of materials that are not capable of stretching or changing shape to accommodate the movements of the athlete. As a result, to alleviate the restrictive nature of the garment, the athlete either removes the garment for short periods of time to perform activities or wears a garment that is significantly oversized for the athlete's body. As an example, in the sport of golf, the golf swing of an athlete requires a wide range of motion that is hindered or restricted by a traditional jacket. Thus, the athlete often wears a jacket or other garments in between shots, but the athlete then removes the jacket to make a golf swing. Such a removal process is cumbersome, frustrating, and results in a loss of heat of the athlete when the garment is removed.

Other garments have looked to overcome these limitations by utilizing elastic material to form the garment or by including small segments of elastic material between the seams of a garment—such as between a sleeve and a shoulder portion of a jacket. The use of elastic material, however, often adds significant weight to the garment as elastic materials are generally heavier than inelastic materials. Elastic materials may also be less weather-resistant or durable than their inelastic counterparts. In addition, the incorporation of multiple small elastic components requires significant additional labor or manufacturing time to produce.

The present technology alleviates the issues discussed above, among others, by providing insulated paneling for, and in, garments that allows for the garment to both expand with movement of the athlete and concurrently keep the athlete warm. While accepted or traditional wisdom suggests that elastic materials should be used to provide flexibility, the present technology proceeds against that traditional wisdom and allows for lightweight, inelastic materials to be used while still providing an expandable garment. As such, the athlete is able to continue participating in their respective activities without having to remove the garment or wear an improperly sized garment. The insulated paneling provides heat insulation as well as flexibility through the use of an innovative combination of insulated panels and gussets located between the insulated panels. When the insulated paneling is pulled outward, the gussets expand, which allows the insulated paneling as a whole to expand. When the outward pulling force is removed, the insulated paneling may retract to its initial shape and position. Thus, when the insulated paneling is incorporated into a garment, the garment can expand with movement of the athlete and return to its normal shape when the motion of the athlete ceases.

FIG. 1A depicts a perspective view of an example active-insulation paneling component 100. The active-insulation paneling component 100 is a component that is to be incorporated into a garment, such as the garments described above, to provide both warmth and an increased range of motion for the garment.

The example active-insulation paneling component 100 includes a first material layer 102 that is partially attached or fastened to a second material layer 104. The first material layer 102 may be a sheet of material, and the second material layer 104 may also be a sheet of material. In some examples, the material of the first material layer 102 may be the same material as the second material layer 104. The material used for one or both the first material layer 102 and/or the second material layer 104 may be a fabric, such as a fabric woven ripstop or other lightweight woven fabrics. In some examples, the material may be relatively lightweight in that the material may have a weight of less than 50 grams per square meter (gsm), and preferably between 10 gsm and 50 gsm. Most preferably, the material may have a weight of between 25 gsm and 40 gsm, such as 35 gsm.

In other examples, the material of the first material layer 102 may be different from the material of the second material layer 104. For instance, the first material layer 102 may made from a material that is more durable and weather-resistant where the first material layer 102 is intended to be on the exterior of a garment. For example, the first layer 102 may be water resistant or hydrophilic. In such an example, the material of the second material layer 104 may be less durable when the second material layer 104 is intended to face inward (towards the body of the wearer), such as a jacket liner. The material of the first material layer 102 and the second material layer 104 may be a material that does not stretch or expand. Despite the material being a non-elastic or stretching material, the active-insulation paneling component 100 still provides for expansion and contraction to allow for movement, as discussed further below.

The first material layer 102 and the second material layer 104 may be partially fastened to one another through a series of stitch lines 106. The stitch lines 106 are indicated by the dashed lines in FIG. 1A. The stitch lines 106 may partially define, or provide borders between, different segments or portions of the active-insulation paneling component 100. In the example depicted, alternating insulated panels 110 and gussets 112 are formed. The insulated panels 110 are filled with insulation 108. The insulation 108 may be blown-in insulation rather than a sheet of insulation. As discussed further below, the insulated panels 110 may be defined on two sides by stitch lines 106. The example active-insulation paneling component 100 includes five insulated panels 110, but a greater or fewer number of insulated panels 110 may be incorporated into the example active-insulation paneling component 100. For instance, an active-insulation paneling component 100 may include at least three, four, five or more insulated panels 110. By including additional insulated panels 110 and corresponding gussets 112, additional insulative and expansion properties may be achieved.

In the example depicted, a gusset 112 is located in between each of the insulated panels. The gussets 112 are formed from folded portions of the first material layer 102 and the second material layer 104 when those layers are attached or fastened together and folded. The fold pattern and construction of the gussets 112 are discussed in further detail below. The gussets 112 allow for expansion of the example active-insulation paneling component 100.

Each end of the example active-insulation paneling component 100 may also include an end portion 114. The end portions 114 provide for an attachment surface or area that allows the example active-insulation paneling component 100 to be more easily incorporated into a garment. For instance, the end portions 114 provide a surface that can fastened (e.g., stitched) to another piece of material forming the larger garment.

Figure 1B:
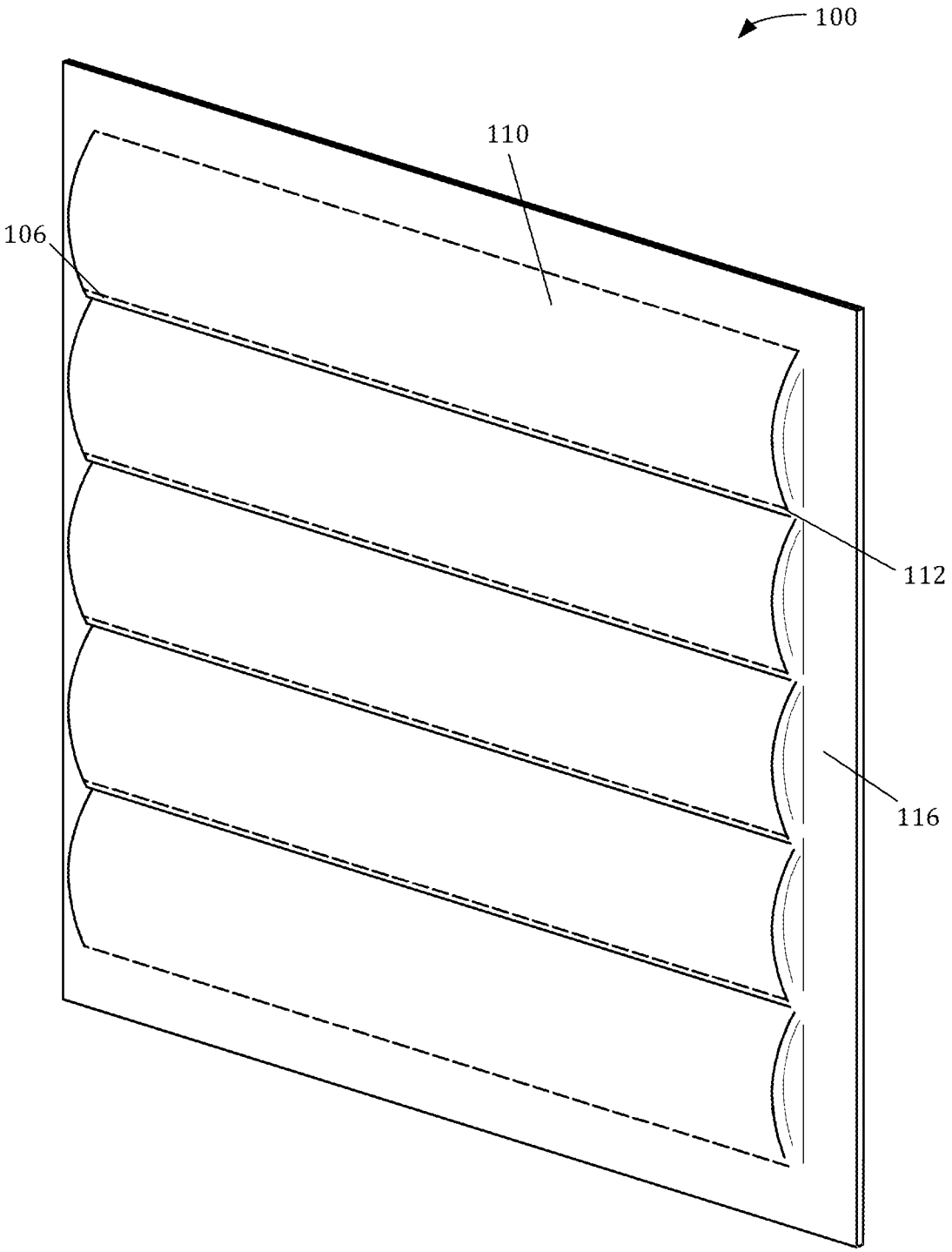
FIG. 1B depicts the example active-insulation paneling component with a binding attached to the outer borders of the example active-insulation paneling component.

FIG. 1B depicts the example active-insulation paneling component 100 with a binding 116 attached to the outer borders of the example active-insulation paneling component 100. The binding 116 may be added to further seal the edges or border of the example active-insulation paneling component 100. For example, to prevent the insulation in the insulated panels 110 from falling out, the insulated panels 110 may be sealed on both sides, such as by stitching each end of each of the insulated panels 110. The sealing of the insulated panels 110 may be achieved by finishing stitch lines and/or adding the binding 116 around the border the example active-insulation paneling component 100.

In other examples, the binding 116 may not be included and the ends of the insulated panels 110 may be sealed when the example active-insulation paneling component 100 is incorporated into a garment. For instance, when the example active-insulation paneling component 100 is incorporated into a garment, the example active-insulation paneling component 100 may be fastened (e.g., stitched, melted, welded, glued, tacked, etc.) to the garment on all sides of the example active-insulation paneling component 100. The fastening process may seal the ends of the insulated panels 110 during the process. However, when the example active-insulation paneling component 100 is manufactured separately from the ultimate garment, the binding 116 may increase the durability of the example active-insulation paneling component 100 for shipping or transport. In other examples, a finishing stitch line may be applied to close one or more ends of the insulated panels 110 but no additional material is added as a binding.

Figure 2A:
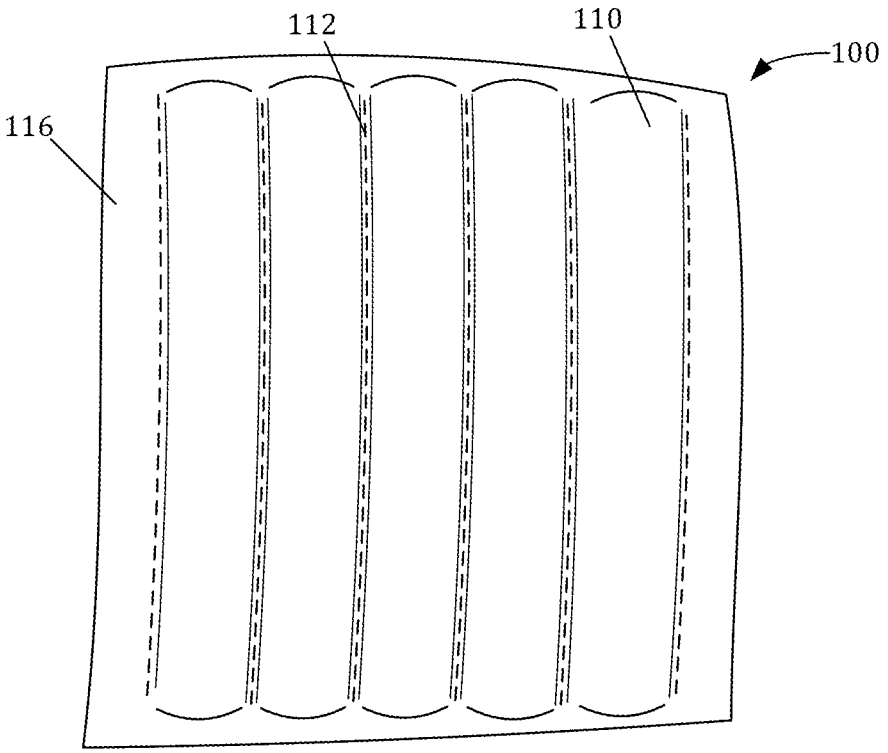
FIG. 2A depicts a front view of the example active-insulation paneling component in a closed state.

FIG. 2A depicts a front view of the example active-insulation paneling component 100 in a closed state. In the closed state, the gussets 112 may be barely visible as they remain folded and behind the insulated panels 110. FIGS. 1A-1B similarly depicted the example active-insulation paneling component 100 in the closed state. In some examples, from the front view, gussets 112 may not be visible at all because edges of the insulated panels 110 may be in contact with one another blocking the view of the gussets 112. When in the closed state, the example active-insulation paneling component 100 is in its normal or compact form factor when no external human forces are applied to the example active-insulation paneling component 100.

Figure 2B:
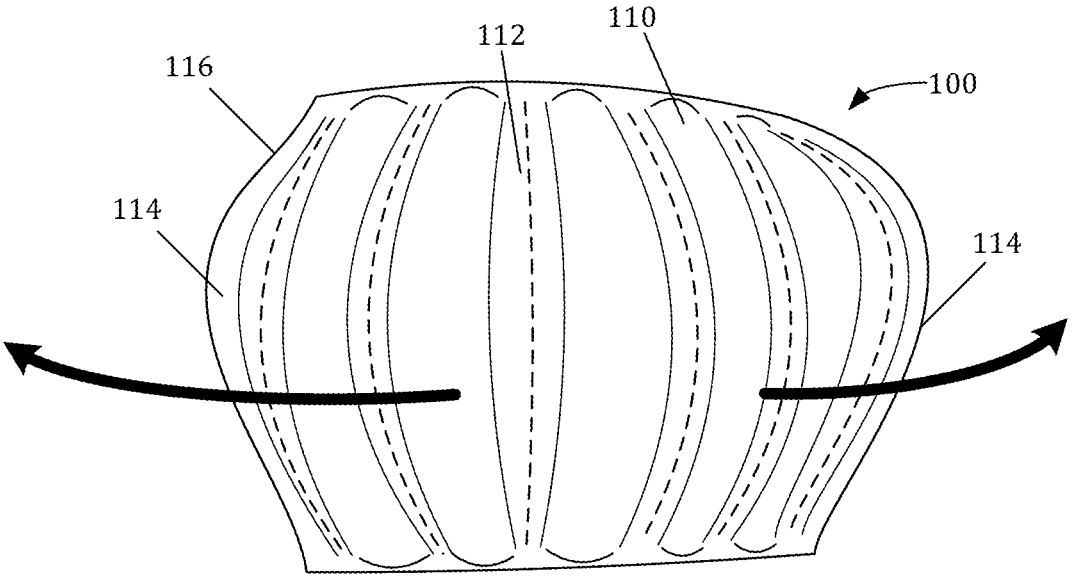
FIG. 2B depicts a front view of the example active-insulation paneling component in an expanded state.

FIG. 2B depicts a front view of the example active-insulation paneling component 100 in an expanded state. The example active-insulation paneling component 100 may enter the expanded state when a force is applied pulling the example active-insulation paneling component 100 outwardly, in a direction as indicated by the black arrows. The pulling force may be applied by pulling one or more of the end portions 114 outward from the center of the example active-insulation paneling component 100. The direction of the force may be considered a direction that is substantially parallel to a line that passes through the alternating pattern of gussets 112 and insulated panels 110.

The application of the pulling force causes the gussets 112 to expand, which allows for expansion of the example active-insulation paneling component 100. Expansion of the gussets 112 occurs due to the gussets 112 at least partially unfolding in response to the pulling force. When the example active-insulation paneling component 100 is in the expanded state, the gussets 112 are more visible than when the example active-insulation paneling component 100 is in the closed state. In some examples, the central stitching in the gussets 112 may become visible.

The pulling force may be applied by a human when the example active-insulation paneling component 100 is incorporated into a garment. For instance, when the end portions 114 are attached to a garment, pulling forces on those end portions may be applied when the athlete moves. In an example where the active-insulation paneling component 100 is incorporated into a portion of a glove, when the athlete clenches his or her fist, that action may cause a pulling force on the end portions 114 that causes the active-insulation paneling component 100 to expand and be in the expanded state. Similarly, and as discussed in further detail below with reference to FIGS. 8A-8C, 9 and 10, in examples where the example active-insulation paneling component 100 is incorporated into a jacket, motions of a golf swing may apply the pulling force on the example active-insulation paneling component 100. Because the gussets 112 expand in response to the pulling force, the garment with the active-insulation paneling component 100 is less restrictive than an equivalent garment without the example active-insulation paneling component 100.

Figure 3B:
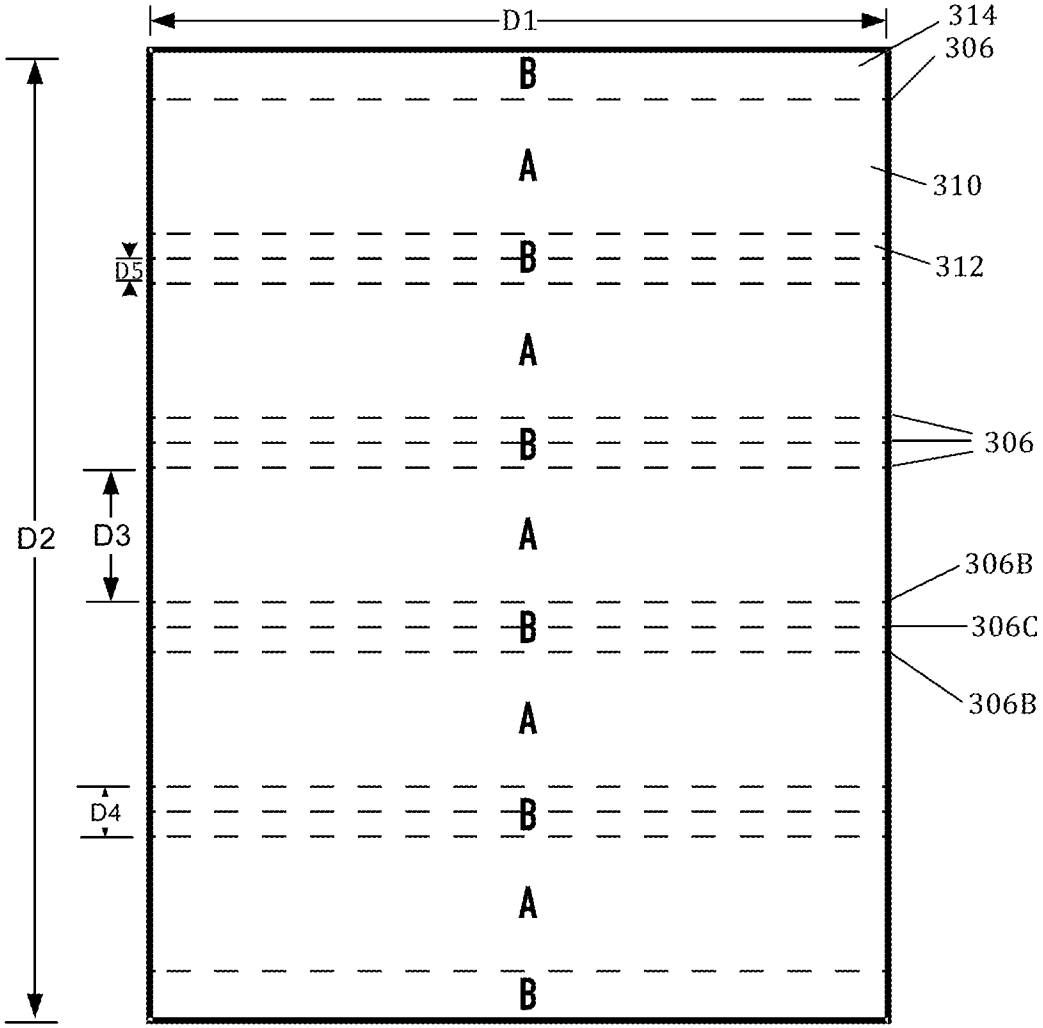
FIGS. 3A-3B depict an example step in manufacturing an example active-insulation paneling component.
Figure 3A:
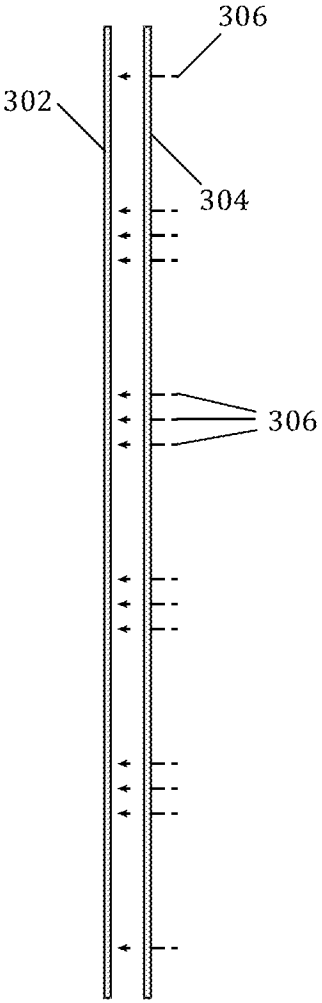

FIGS. 3A-3B depict an example step in manufacturing an example active-insulation paneling component. More specifically, FIG. 3A depicts a side view of a first material layer 302 and a second material layer 304 that are being joined together via a series of stitch lines 306. FIG. 3B depicts a front view of the same features. FIGS. 3A and 3B are discussed concurrently. The first material layer 302 may be formed as a continuous layer of material, such as a sheet of material. The second material layer 304 may similarly be formed as a continuous layer of material, such as a sheet of material. As discussed above, the first material layer 302 and the second material layer 304 may be formed from the same or different materials.

Multiple stitch lines 306 are applied through the first material layer 302 and the second material layer 304 to join or partially attach the first material layer 302 to the second material layer 304. The stitch lines 306 define or create different structures in the joined first material layer 302 and second material layer 304. For instance, a channel or tube is formed for each portion that will form an insulated panel 310. Each of the portions that form, or will form, an insulated panel 310 is marked with an "A" in FIG. 3B (this marking system remains consistent through FIGS. 4-7 as well).

The stitch lines 306 also define and help form the gussets 312. The stitch lines 306 may define fold points for the gussets 312. Each of the portions that form, or will form, a gusset 312 is marked with a B in FIG. 3B (this marking system remains consistent through FIGS. 4-7 as well). The end portions 314 are also marked with a B. Each gusset 312 may include three stitch lines 306. Two of the stitch lines 306 define the borders of the gusset 312. Another stitch line 306 may be formed in the central region of the gusset.

While the Sections A and B are also marked with reference numeral 310 for an insulated panel and reference numeral 312 for a gusset, respectively, it should be appreciated that at the manufacturing stage depicted in FIGS. 3A-3B, insulated panels 310 and gussets 312 are not yet fully formed. For instance, the Sections A have not yet been filled with insulation, and the Sections B have not yet been folded to form a gusset. Accordingly, each Section A for forming an insulated panel 310 may be referred to as an insulation-panel-formation section, and each Section B for forming a gusset 312 may be referred to as a gusset-formation section. Similarly, the stitch lines 306 may be referred to as formation stitch lines 306 as they result in the formation of the different sections.

Example border stitch lines 306B and a central stitch line 306C are identified in FIG. 3B. The border stitch lines 306B define the borders of the insulation-panel-formation sections and the borders of the gusset-formation sections. For instance, an adjacent insulation-panel-formation section and gusset-formation section share a common border stitch line 306B. The border stitch lines 306B delineate the insulation panel-formation sections and the gusset-formation sections. The central stitch line 306C may be located in the middle of the gusset 312, or in other words, equidistant from the border stitch lines 306B defining the boundary of the gusset 312. In other examples, the central stitch line 306C may be off-center to define a different fold point for the gusset 312, which may provide different functional expansion properties suitable for different types of implementations.

FIG. 3B also depicts several dimensions that may be utilized in manufacturing the example active-insulation paneling component. The width of the paneling component at this stage of manufacturing (e.g., pre-folding) is indicated by the dimension D1, and the length is indicated by the dimension D2. In some examples the length may be greater than or equal to the width. In other examples, the width may be greater than the length. The formation stitch lines 306 may extend substantially across the width of the paneling component. For instance, the length of the formation stitch lines 306 may be at least 90% of the width (D1) of the paneling component.

The width of the section A for the insulated panel 310 (e.g., the distance between the border stitch lines 306 defining the Section A) is indicated by dimension D3. The width of the Section B for the gusset 312 (e.g., the distance between the border stitch lines 306 defining the Section B) is indicated by the dimension D4. The distance between the border stitch lines 306 defining the section B and the central stitch line 306 is indicated by dimension D5.

In the example depicted, the width of the Section A for the insulated panel 310 is greater than the width of the Section B for the gusset 312 (i.e., D3>D4). By having D3 be greater than D4, additional insulative properties are provided by the resultant paneling component. The width of Section A (D3) may also change or vary such that the ultimate paneling component includes insulated panels having different widths.

In some examples, an insulation panel-to-gusset width ratio of at least 2:1 may be utilized (e.g., D3>2*D4). Other examples of the panel-to-gusset width ratios may be within the range of: 0.1*D3<D4<0.5*D3. Increasing the width (D4) of the section B for the gusset 312 may also provide some additional expansion properties to the paneling component. For example, a wider gusset 312 may be able to expand further than a narrower gusset 312. However, there may be some limits on the width of the gusset 312 where additional fabric length does not provide additional expansion due to the other dimensions of the paneling component. In some examples, the gusset 312 width (D4) may be less than half or a third the component width (D1) (e.g., D4<D1/2 or D4<D1/3). In examples where the central stitch line 306 is centered between the border stitch lines 306 defining the Section B, the dimension D5 is half of the dimension D4. In one specific, non-limiting example, D1 is about 11 inches, D2 is about 14.5 inches, D3 is about 2 inches, D4 is about 0.75 inches, and D5 is about 0.375 inches.

Figure 4B:
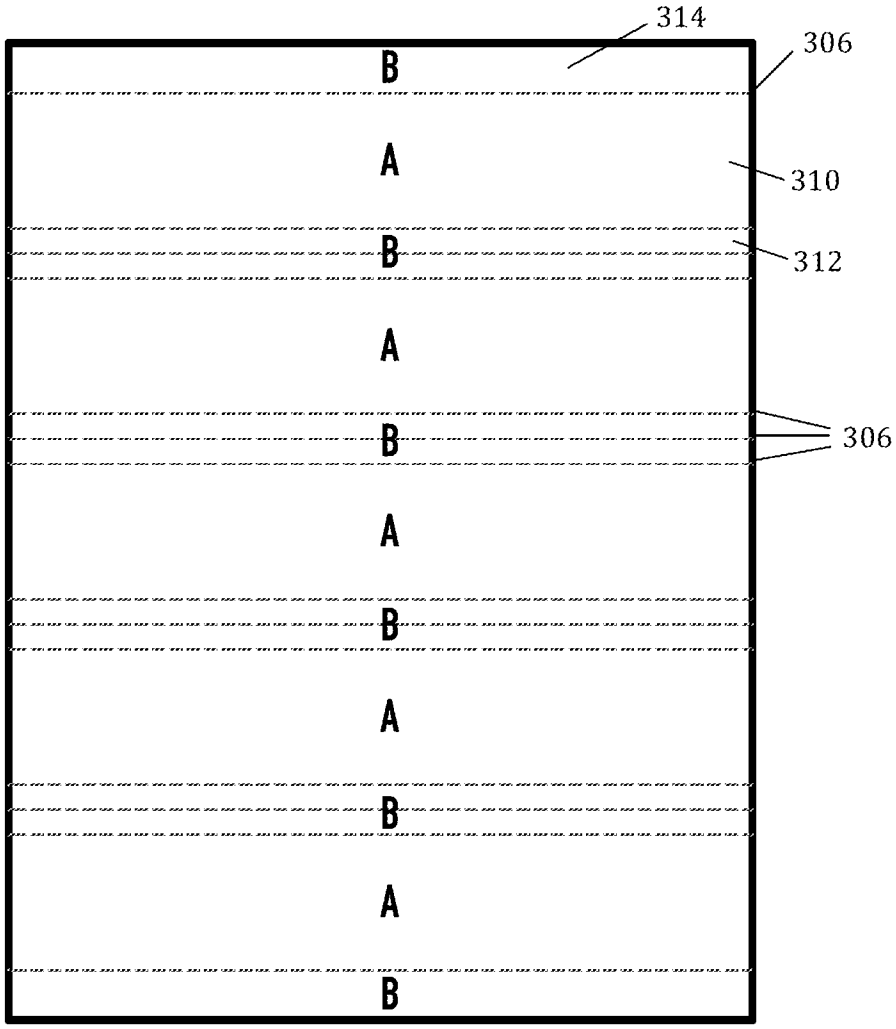
FIGS. 4A-4B depict another example step in manufacturing an example active-insulation paneling component.
Figure 4A:
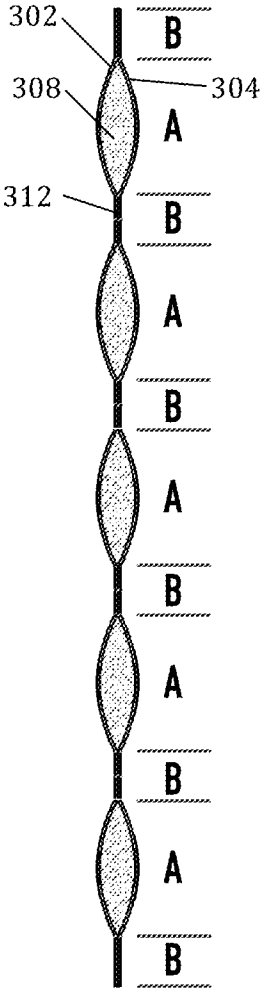

FIGS. 4A-4B depict another example step in manufacturing an example active-insulation paneling component. More specifically, FIG. 4A depicts a side view of the first material layer 302 and the second material layer 304 after being joined together and having the insulation-panel-formation sections filled with insulation 308. FIG. 4B depicts a front view of the same features. After the first material layer 302 and the second material layer 304 are joined by the stitch lines 306 as discussed above with reference to FIGS. 3A-3B, insulation 308 may be added. The insulation may be blown into the tubes or channels formed by each section A for the insulated panels 310. The insulation may be a light-weight insulation that still has high insulation properties. For instance, the light-weight insulation may be non-woven insulation. One example insulation is a ZIRAN THERMOLITE Poly Down Blown Insulation FL-3.

As can be seen in FIG. 4A, filling the insulation-panel-formation sections (Sections A) with insulation 308 results in the insulated panels 310 having a thickness based on the amount of insulation 308 added and the width (D3) of the sections A used to form the insulated panel 310. The gusset-formation sections (Sections B) for forming the gussets 312, however, may remain flat at this manufacturing step, as also shown in FIG. 4A. In other examples, while not depicted in FIG. 4A, the Sections B may be at least partially filled with insulation 308 as well. For example, after the stitch lines 306 are applied, the Sections B include two smaller tubes or channels. Those tubes or channels may be at least partially filled with insulation 308. Those smaller tubes of Section B may be filled to a less degree (e.g., a smaller percentage of total possible fill) than the tube of Section A to allow for the folding of the material in Section B to form the gusset 312. In some examples, once filled with insulation, the insulation-panel-formation sections may have a thickness between 0.2-1.0 inches and thickness of the gusset-formation sections may have a thickness of less than 0.15 inches.

Figure 5C:
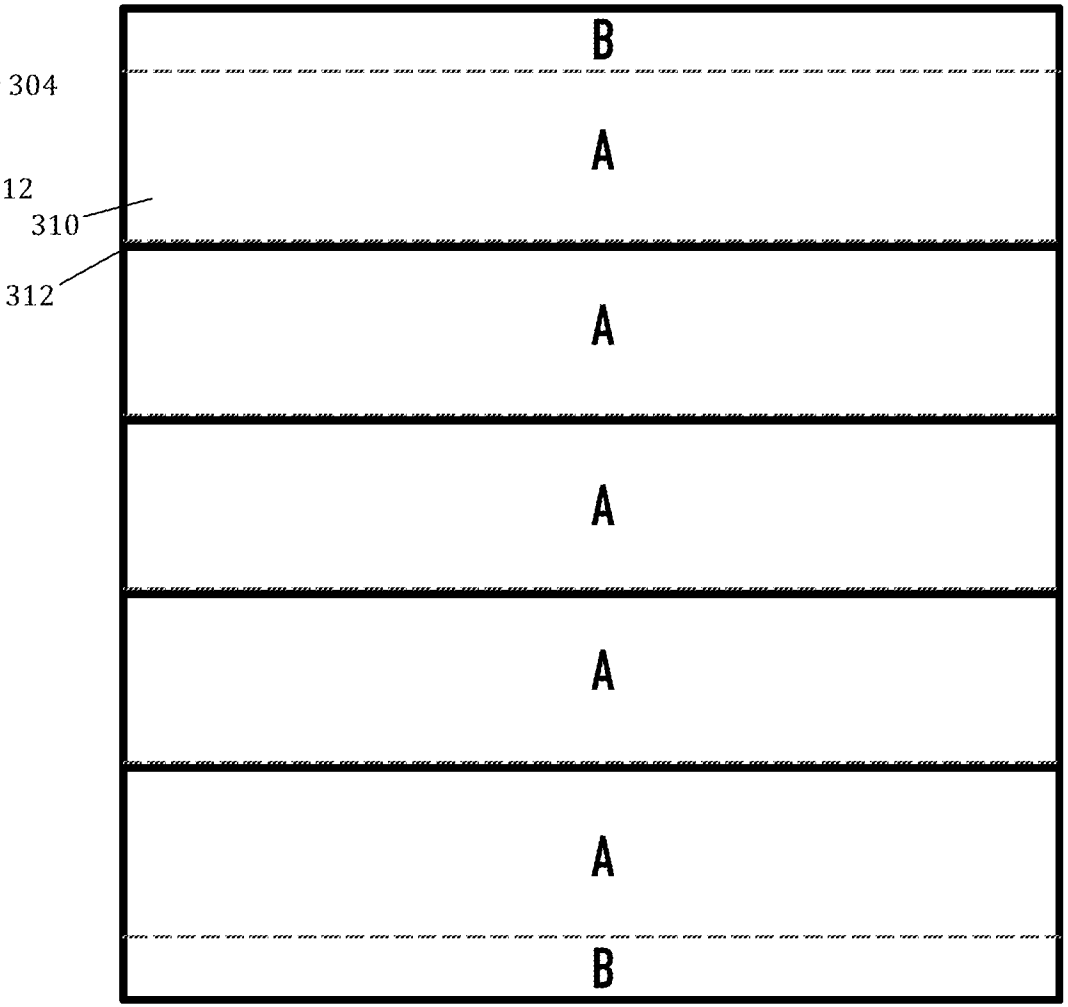
FIGS. 5A-5C depict another example step in manufacturing an example active-insulation paneling component.
Figure 5B:
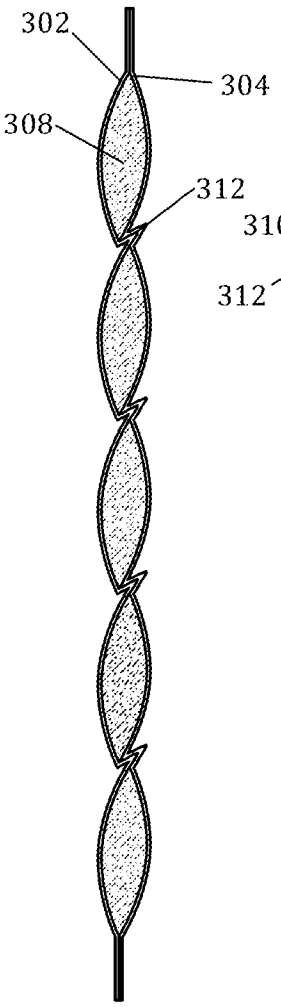
Figure 5A:
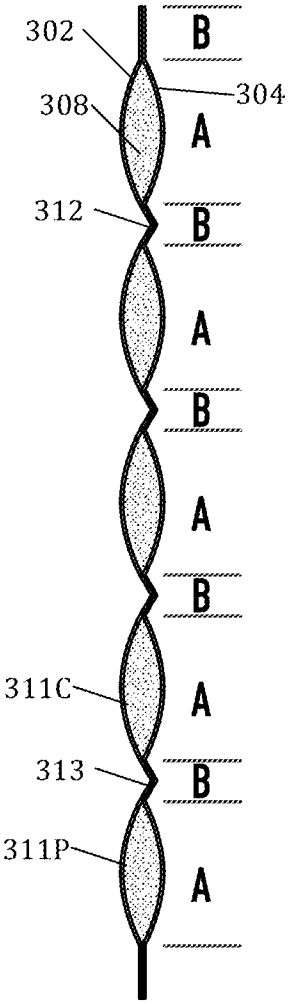

FIGS. 5A-5C depict another example step in manufacturing an example active-insulation paneling component. More specifically, FIG. 5A depicts a side view of the paneling component at a beginning of a fold for the gusset-formation sections (Sections B) that will form the gussets 312. The initial fold stage includes folding the Sections B along the central stitch line 306 to bring an edge of one Section A to the edge of an adjacent Section A. For instance, as depicted, Section B is folded so that the top edge of Section A meets the bottom edge of the Section A above it. FIG. 5B shows a side view of the paneling component after the folding has been completed. As can be seen, the edges of adjacent Sections A or insulated panels 310 have been brought into proximity with one another.

An edge of one Section A may overlap an edge of the adjacent Section A, as shown in FIG. 5B. The folded Section B will point or extend in one direction or the other depending on which Section A edge overlaps the other. Reference to different Sections A or insulated panels 310 may be made with respect to their location relative to the center of the paneling component (along the length of the paneling component). For instance, a specific gusset-formation section 313 (Section B) has been marked in FIG. 5A. That gusset-formation section 313 has two adjacent insulation-panel-formation sections (Sections A) marked as 311C and 311P. The insulation-panel-formation section 311C, with respect to the identified gusset-formation section 313, is referred to as the central insulation-panel-formation section 311C because it is towards the center of the paneling component from the gusset-formation section 313. The insulation-panel-formation section 311P, with respect to the identified gusset-formation section 313, is referred to as the peripheral insulation-panel-formation section 311P because it is towards the periphery (e.g., away from the center) of the paneling component from the gusset-formation section 313.

In the example folding operation depicted in FIG. 5B, the fold of gusset-formation section 313 causes the border of the central insulation-panel-formation section 311C to overlap the border of the peripheral insulation-panel-formation section 311P. In other words, the border of the central insulation-panel-formation section 311C is on top of (towards the front of the paneling component) of the border of the peripheral insulation-panel-formation section 311P. Such a configuration causes the resultant gusset to extend towards the center of the paneling component. As should be appreciated, if the folding operation caused the border of the peripheral insulation-panel-formation section 311P to overlap the border of the central insulation-panel-formation section 311C, the resultant gusset would point towards the periphery of the paneling component.

The direction the gusset points may have some functional effect on how the gussets expand and retract do to how the gusset unfolds. As a result, in some examples, for all folds of the gusset-sections, the respective central insulation-panel-formation sections may overlap the respective peripheral insulation-panel-formation sections, which causes all the gussets to point towards the center of the paneling component. Such a configuration provides symmetry across the paneling component that may improve or produce more symmetrical expansion and retraction of the paneling component. In other examples, for all folds of the gusset-sections, the respective peripheral insulation-panel-formation sections may overlap the respective central insulation-panel-formation sections, which causes all the gussets to point towards the periphery of the paneling component. Such a configuration also provides symmetry across the paneling component that may improve or produce more symmetrical expansion and retraction of the paneling component.

FIG. 5C depicts a front view of the paneling component after the folding has been completed. As can be seen from FIG. 5C, the gusset-formation sections (Sections B) that form the gussets 312 may no longer be visible, or may be minimally visible, from the front view after the folding step.

Figure 6:
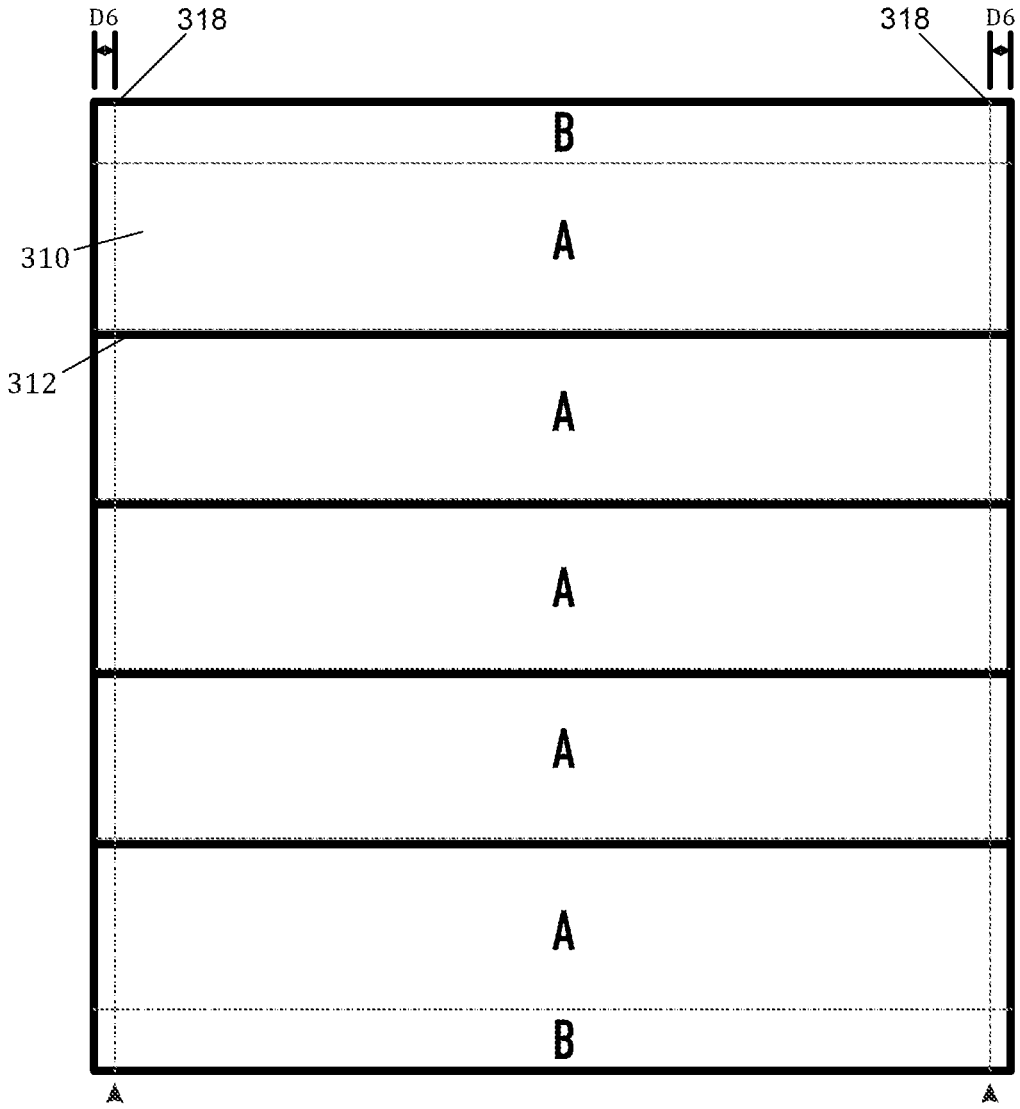
FIG. 6 depicts another example step in manufacturing an example active-insulation paneling component.

FIG. 6 depicts another example step in manufacturing an example active-insulation paneling component. More specifically, FIG. 6 depicts a front view of the paneling component after the folds discussed above have been completed and finishing stitch lines 318 are added. After the folds discussed above regarding FIGS. 5A-5C are completed, one or more continuous finishing stitch lines 318 may be added. The finishing stitch lines 318 seal the tubes or channels that have been filled with insulation 308. The finishing stitch lines 318 also fix the folds to make the folds permanent by attaching the edges of the Sections A brought together during the fold. For instance, at the finishing stitch lines 318, the edges of the Sections A are joined together, and the gussets 312 are formed. Accordingly, the folds of the gusset-formation sections (Sections B) are fixed at the finishing stitch lines 318. The borders of the adjacent Sections A are thus joined at two positions, but the borders may be joined at additional positions where additional finishing stitch lines 318 are used.

The finishing stitch lines 318 may be inset from the outer edges of the paneling component by a distance indicated by dimension D6. The inset distance D6 may be set based on the type of binding that may be applied to the paneling component and/or the amount of surface area desired for attached or otherwise incorporating the paneling component into a garment. In some examples the dimension D6 may be about ¼ inch, but the value D6 may be based on the overall size of the paneling component.

Figure 7B:
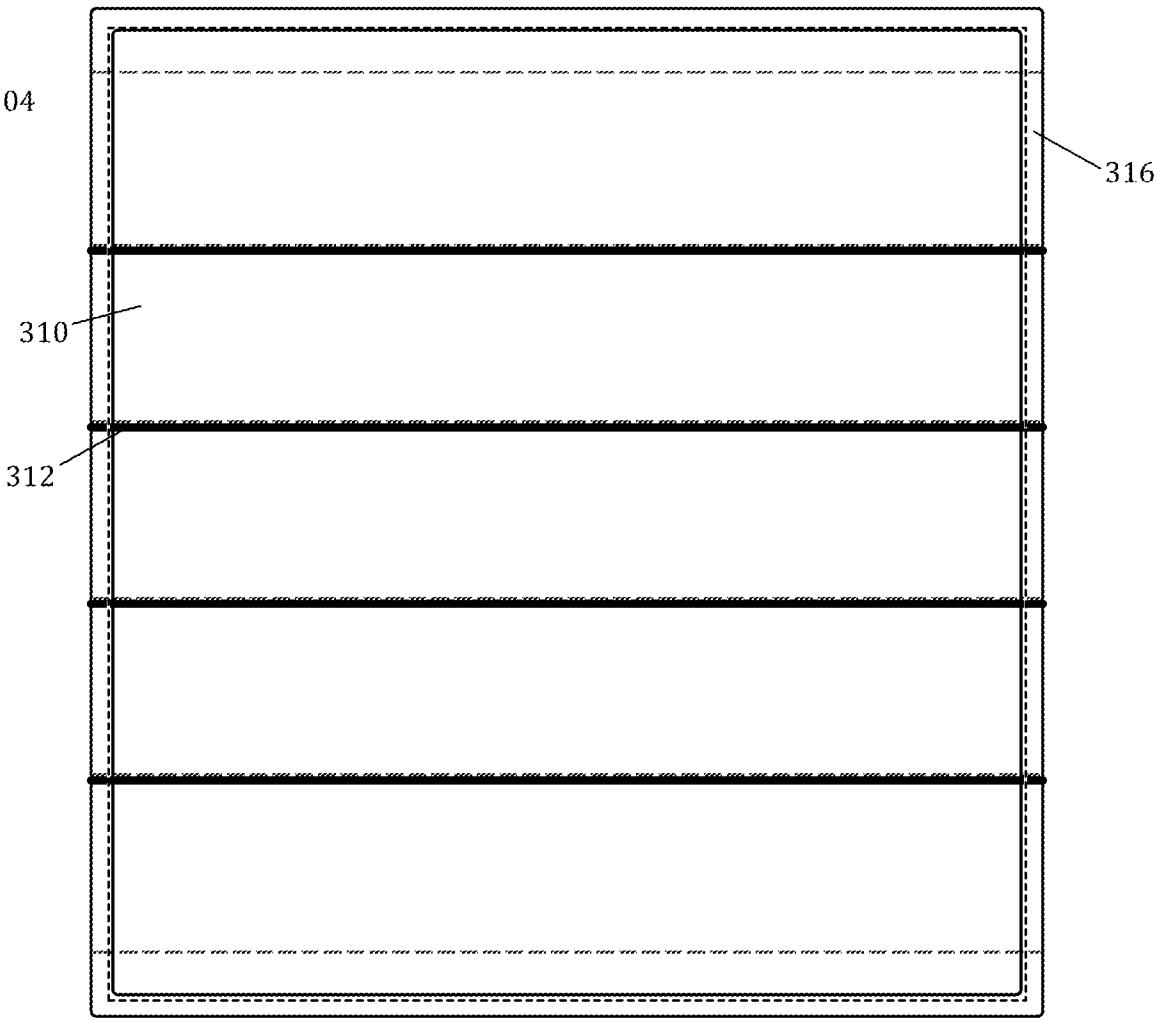
FIGS. 7A-7B depict another example step in manufacturing an example active-insulation paneling component.
Figure 7A:
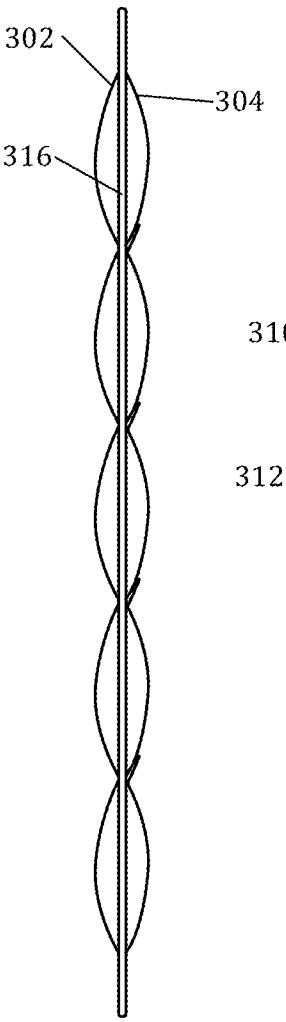

FIGS. 7A-7B depict another example step in manufacturing an example active-insulation paneling component. For specifically, FIG. 7A depicts a side view of the paneling component after a binding 316 has been added to the paneling component. FIG. 7B depicts a front view of the paneling component after the binding 316 has been added. After the finishing stitch lines 318 have been added, as described above with reference to FIG. 6, a binding 316 may be attached to the paneling component. In some examples, the binding 316 may be added prior to, or in lieu of, the finishing stitch lines 318.

The binding 316 may be attached around the entire perimeter of the paneling component (e.g., around all of the exterior edges or sides of the paneling component). In other examples, the binding 316 may be attached to less than all the sides of the paneling component. For instance, the binding 316 may be attached to only the pair of sides running the length of the paneling component. Alternatively, the binding 316 may be attached only to the pair of sides running the width of the paneling component.

The binding 316 may extend inwardly on the paneling component, on the front and back of the paneling component, by distance of approximately or about the distance D6 depicted in FIG. 6. The binding 316 may be made from a material that the is the same or different as the material used as the first material layer 302 and/or the second material layer 304. In some examples, the binding 316 may be made from a heavier weight material than the first material layer 302 and/or the second material layer 304.

While the term "stitch line" has been used above to describe the joining lines and sealing lines for the paneling component, it should be understood that the term stitch line is not limited solely to stitches. For instance, as used herein a stitch line may include any type of method for joining two pieces of materials, such as fabrics, together, including stitching, welding, melting, adhering, etc.

Figure 8A:
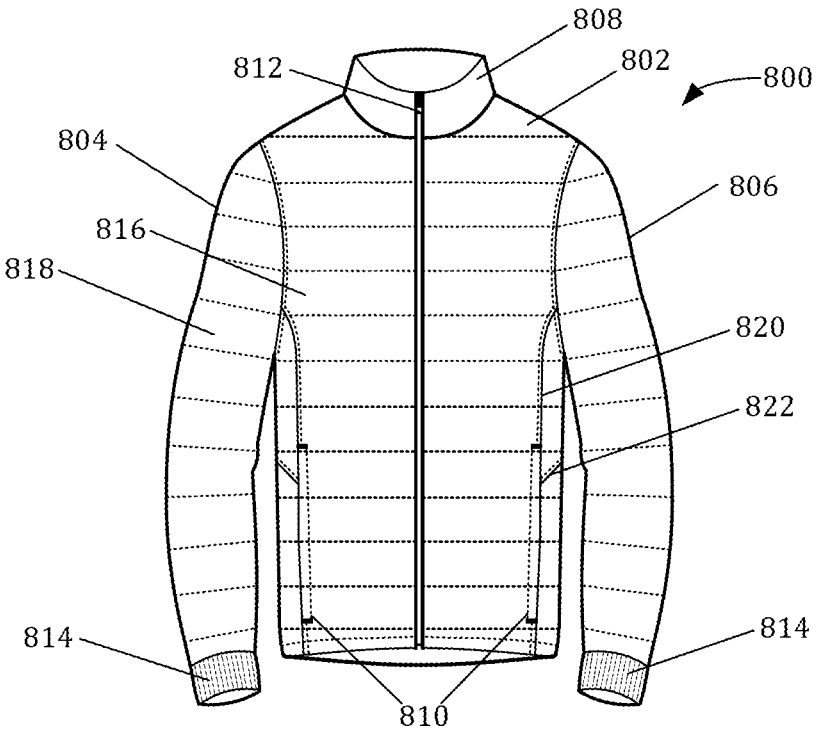
FIG. 8A depicts a front view of an example jacket.

FIG. 8A depicts a front view of an example jacket 800. The jacket 800 includes a torso portion 802, a right sleeve 804 attached to the torso portion 802, and a left sleeve 806 attached to the torso portion 802. A collar 808 is also at least partially attached to the torso portion 802. A zipper 812 may be included that runs the whole length of the jacket 800. In other examples, the zipper 812 may run a quarter or half of the jacket 800 to form a quarter-zip or half-zip jacket. One or more pockets 810 may also be incorporated into the torso portion of the jacket.

The front, or chest, side of the jacket may include insulated segments 816. The insulated segments 816 may generally extend laterally (e.g., across the body from left-to-right or right-to-left). For instance, the lateral dimension of one or more of the insulated segments 816 may be greater than the height or vertical dimension of the insulated segments 816. In some examples, the insulated segments 816 may be manufactured by incorporating a sheet of insulation (rather than blown-in insulation) between two sheets of material and applying stitch lines to form a quilt pattern as shown in FIG. 8A. The outer material for the insulated segments 816 may be the same as the material used as the first material layers and/or the second material layers for the active-insulation paneling component discussed above.

The right sleeve 804 and the left sleeve 806 may also include insulated segments 818. The insulated segments 818 may be manufactured similarly to, and share similar properties as, the insulated segments 816 in the torso portion 802. The right sleeve 804 and the left sleeve 806 may also each include a cuff 814. The cuffs 814 may be made from elastic material to better cling or form to the wrists of the wearer.

Figure 8B:
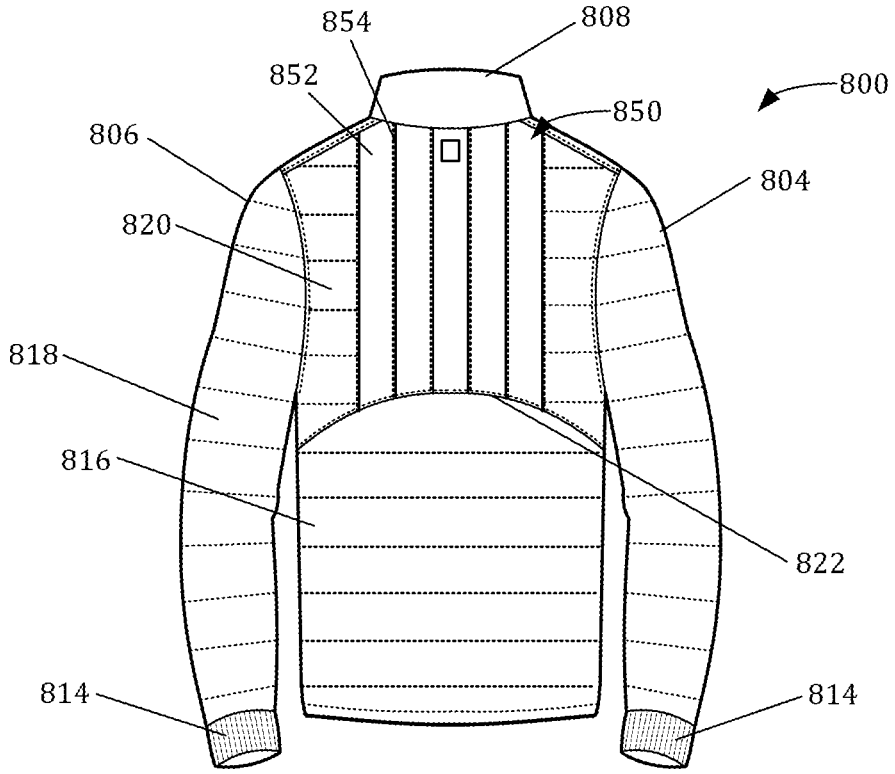
FIG. 8B depicts a rear view of the example jacket in a closed state.
Figure 8C:
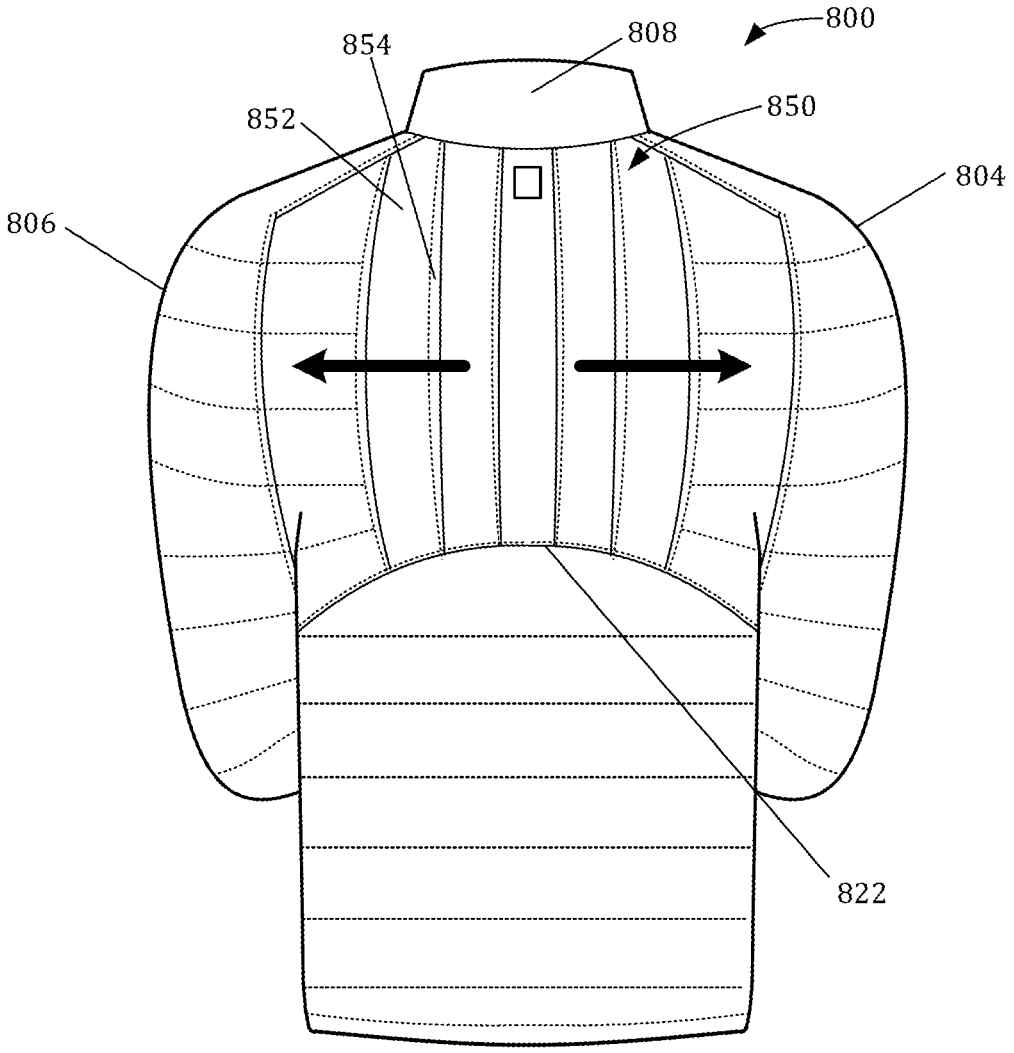
FIG. 8C depicts a rear view of the example jacket in an expanded state.

FIG. 8B depicts a rear view of the example jacket 800 having an active-insulation paneling component 850 incorporated into the back of the jacket 800. FIG. 8B depicts the active-insulation paneling component 850 in a closed state, such as when the wearer would be relatively at rest and not exerting any pulling forces on the active-insulation paneling component 850. FIG. 8C depicts a rear view of the example jacket 800 with the active-insulation paneling component 850 in an expanded state. The active-insulation paneling component 850 may be in the expanded state when the wearer moves his or her arms or performs actions that cause a pulling force in the direction indicated by the black arrows in FIG. 8C. The pulling force may be considered to be in a direction orthogonal to the formation stitch lines of the active-insulation paneling component 850. For example, when a wearer crosses his or her arms in front of his or her torso, a pulling force is exerted on the edges of the active-insulation paneling component 850 that causes the active-insulation paneling component 850 to expand. Such actions may occur when the wearer is making a golf swing, among other types of activities. The amount of expansion depends on how far the edges of the active-insulation paneling component 850 are pulled apart from one another up to a maximum expansion size.

The active-insulation paneling component 850 includes a plurality of insulated panels 852 and a plurality of gussets 854. A gusset 854 is located in between each pair of insulated panels 852. As discussed above, the gussets 854 allow for the active-insulation paneling component 850 to expand when a pulling force is exerted. The gussets 854 expand, or unfold, in response to the pulling force to allow the active-insulation paneling component 850 and, ultimately, the jacket 800 to expand. Thus, the wearer is able to participate in activities with substantially less restriction from the jacket 800 as compared to a jacket without an active-insulation paneling component 850.

In the example depicted, the active-insulation paneling component 850 includes five insulated panels 852 and four gussets 854. The insulated panels 852 each extend in a vertical direction (e.g., from a head-to-toe or a toe-to-head direction). For instance, the longest dimension of each of the insulated panels 852 is in the vertical direction, and the length of each of the insulated panels 852 is at least four times the width of each of the insulated panels 852. The gussets 854 share a similar length as insulated panel 852 pair for which the respective gusset 854 is located in between.

The active-insulation paneling component 850 is attached or joined to the other portions of the jacket 800 at various locations. For instance, the top of the active-insulation paneling component 850 is joined at least partially to the collar 808. The outer insulated panels 852 may also be joined to a portion of the sleeves 804, 806 at the top of the active-insulation paneling component 850. At the lateral edges of the active-insulation paneling component 850 (e.g., towards each sleeve), the active-insulation paneling component 850 is attached to additional insulated segments 820 on the backside of the torso portion 802. The insulated segments 820 may be similar to the insulated segments 816 on the front side or lower back side of the of the torso portion of the jacket 800. The insulated segments 820 may extend in a direction that is substantially orthogonal to the length of the insulated panels 852.

At the bottom of the active-insulation paneling component 850, a curved stitch line 822 may be used to join the active-insulation paneling component 850 with the lower torso portion 802. In examples where a curved stitch line 822 is used, the lower edge or border of the active-insulation paneling component 850 may also be curved and share a common radius of curvature with the curved stitch line 822. The curved stitch line 822 may extend across the back of the jacket 800 and partially to the to the front of the jacket. For instance, the curved stitch line 822 is also shown in FIG. 8A. The curved stitch line 822 may terminate at the pockets 810 and/or another stitch line(s) congruent with the pockets 810. The rear insulated segments 820 and 816 may also extend into the front of the jacket 800. Having a curved stitch line 822 and a curved bottom edge of the active-insulation paneling component 850 allows for less restriction and a more natural feel of the jacket 800 when the wearer is completing an activity.

Due to the curved stitch line 822 and curved bottom edge of the active-insulation paneling component 850, the insulated panels 852 of the active-insulation paneling component 850 have different lengths. In some examples, the minimum length for any of the insulated panels 852 may be one-third or one-fourth the length of the jacket 800 (measured from top of collar to bottom of torso portion). By having the insulated panels 852 have some substantial length, such as to middle of the back of the wearer, better expansion and less restriction may be achieved. For instance, if the insulated panels 852 are too short, the jacket 800 may still be somewhat restrictive to the wearer.

In some examples, additional flexibility may be added to the jacket 800 by incorporating additional active-insulation paneling components into one or more of the sleeves 804, 806. For instance, an active-insulation paneling component may be incorporated towards the middle of each sleeve, such as near the elbow, to allow for further flexibility of the sleeves 804, 806. Alternatively or additionally, an active-insulation paneling component may be incorporated at the connection point between the sleeve and the torso portion (e.g., at the shoulder). One end of the active-insulation paneling component may be connected to the sleeve 804 or 806 and the other end may be connected to the torso portion 802 to allow for expansion.

Figure 9:
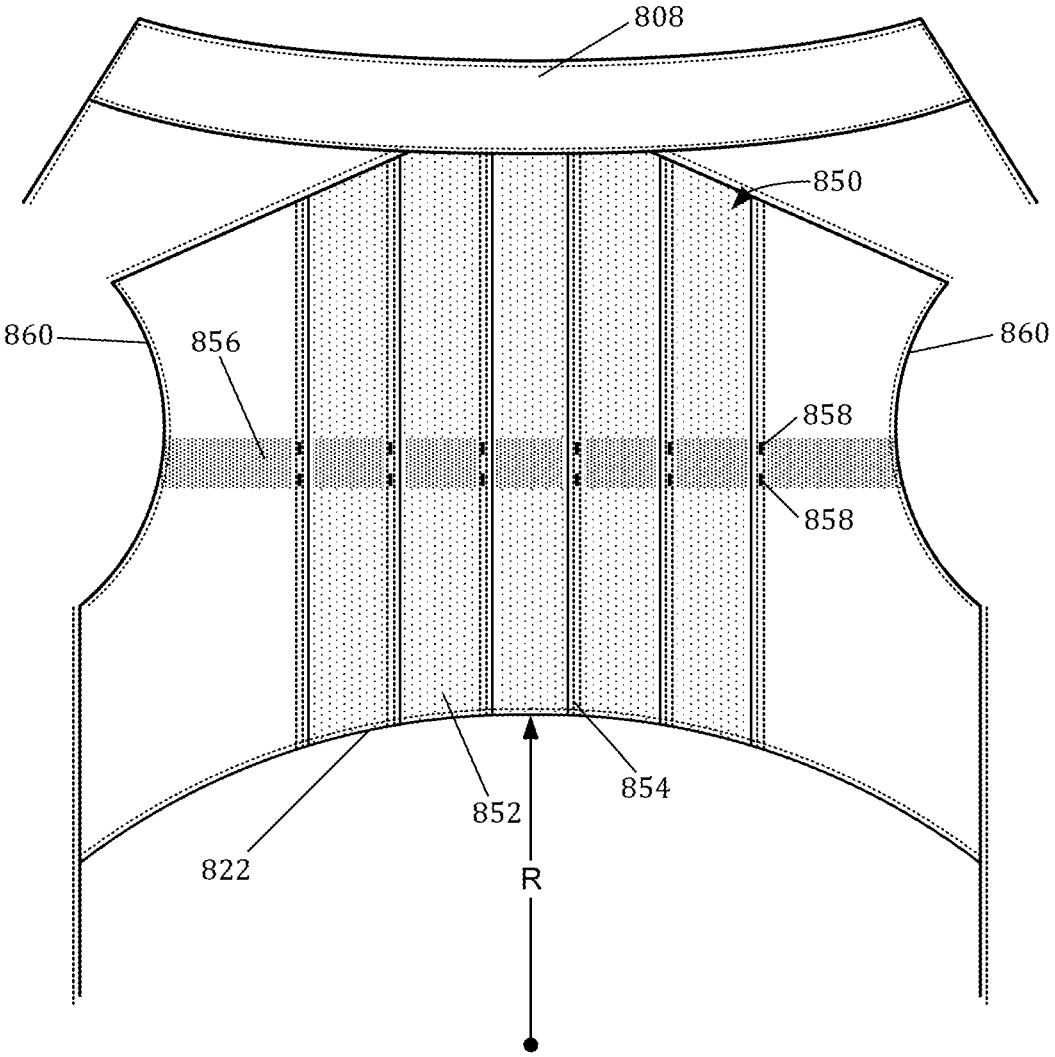
FIG. 9 depicts an interior configuration of the example jacket.

FIG. 9 depicts an interior configuration of the example jacket 800. The interior configuration shown is for a partially completed jacket 800, with the collar 808 partially joined to the active-insulation paneling component 850. The stitch lines joining the lateral edges of the active-insulation paneling component 850 to the remainder of the torso portion, such as the insulated segments 820 of FIG. 8B, can also be seen in FIG. 9. The radius of curvature (R) is also depicted (not to scale) for the curved stitch line 822 and the bottom edge of the active-insulation paneling component 850. In some examples, the average radius of curvature (R) may be greater than 10 inches, 12 inches, or 14 inches and less than 30 inches.

An elastic band 856 may also be incorporated in the interior of the jacket 800. The elastic band 856 may be incorporated to assist with retraction of the active-insulation paneling component 850 from an expanded state to a closed state. For instance, when a wearer completes an action that pulls on the active-insulation paneling component 850 and causes it to expand, the active-insulation paneling component 850 may not fully close or retract on its own. As an example, when the gussets 854 partially unfold or expand, the gussets 854 may not immediately re-fold or retract when the pulling force is removed. To assist with the retraction and assist the gussets 854 and the active-insulation paneling component 850 to return to its closed state, the elastic band may be incorporated into the active-insulation paneling component 850 and/or the jacket 800.

The elastic band 856 is attached at various positions in the jacket 800. The ends of the elastic band 856 may be attached to the sleeve seams or arm holes 860 where the sleeves are to be attached. The elastic band 856 may also be attached to one or more the gussets 854. For instance, in the example depicted, the elastic band 856 is attached to each of the gussets 854 in the active-insulation paneling component 850. The elastic band 856 may be attached or joined to the gussets with bar tacks 858, which is a series of stitches that will be appreciated by those having skill in the art, among other forms of attachment. Two bar tacks 858 may be used for each gusset 854, and the bar tacks 858 may be ¼ inch bar tacks, for example. The bar tacks 858 may be applied through the elastic band 856 and a flat portion of the gusset 854. The elastic band 856 may also be attached to the end portions (e.g., where the active-insulation paneling component 850 connects to the remainder of the torso portion 802) with bar tacks 858 as shown in FIG. 9. Of note, in the example depicted, the elastic band 856 is not attached to any of the insulated panels 852. The elastic band 856 may have a width between 0.5 inches and 3 inches in some examples.

The gussets 854 may all be folded in the same direction or in different directions. For instance, the gussets 854 on one side of the center of the active-insulation paneling component 850 may be folded in one direction and the gussets 854 on the other side of the center may be folded in a different direction. For instance, all the gussets 854 may be folded towards the center or away from the center.

Figure 10:
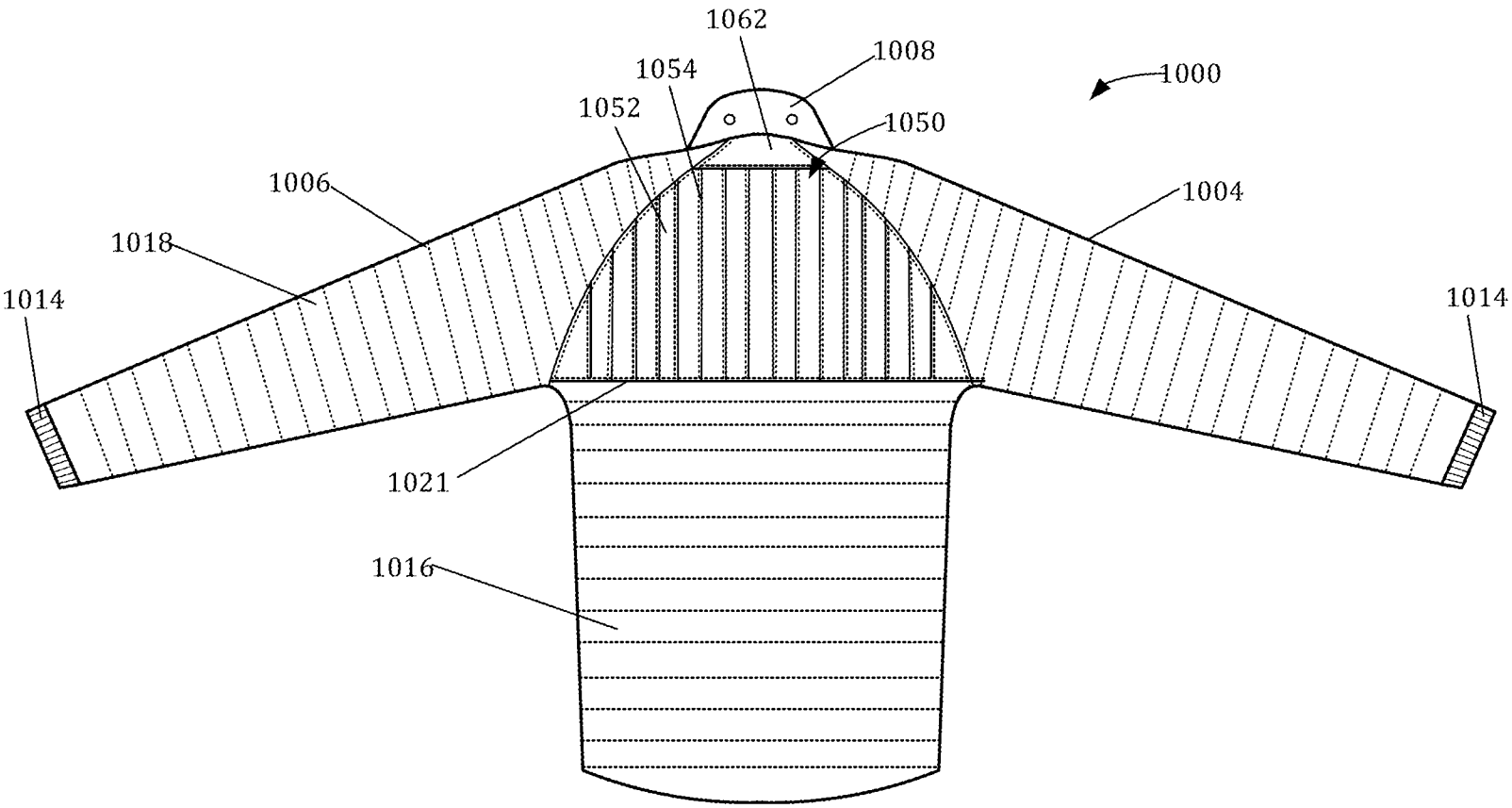
FIG. 10 depicts a rear view of another example jacket.

FIG. 10 depicts a rear view of another example jacket 1000. The example jacket 1000 includes many similar features as the example jackets described above. For instance, the example jacket 1000 includes a right sleeve 1004, left sleeve 1006, cuffs 1014, and a collar 1008. The torso portion of the jacket 1000 includes insulated segments 1016 and the sleeves include insulated segments 1018.

The example jacket 1000 also includes an active-insulation paneling component 1050. The active-insulation paneling component 1050 includes a plurality of insulated panels 1052 and gussets 1054. Like the other active-insulation paneling components discussed above, the gussets 1054 of the active-insulation paneling component 1050 are located in between the insulated panels 1052. The example active-insulation paneling component 1050 also includes more insulated panels 1052 than the paneling components discussed above. The example active-insulation paneling component 1050 in FIG. 10 includes seventeen insulated panels 1052.

The active-insulation paneling component 1050 is incorporated into the jacket by a stitch line 1021 at the lower edge of the active-insulation paneling component 1050. The top edge of the active-insulation paneling component 1050 is attached to a spacing panel 1062 that spaces the active-insulation paneling component 1050 from the collar 1008. For instance, the top side of the spacing panel 1062 may be attached to the collar 1008, the right side of the spacing panel 1062 may be attached to the right sleeve 1004, the left side of the spacing panel 1062 may be attached to the left sleeve 1006, and the bottom portion of the spacing panel 1062 may be attached to the active-insulation paneling component 1050. The spacing panel 1062 allows for the active-insulation paneling component 1050 to be offset from the wearer's neck to provide for additional comfort in some examples.

While the term "jacket" is used to describe the example garment in FIGS. 8A-8C, 9, and 10, the term jacket should be understood to be any type of upper-body garment, includes coats, shirts, vests, parkas, quarter-zip garments, half-zip garments, etc. Similarly, while the jackets are shown to be long-sleeve jackets, the jackets may also be short-sleeve jackets.

Depending on the particular garment and its intended application, the materials used to form the garment may have different properties, such as being water repellant, breathable, etc. For instance, hydrophobic coatings may be used as a final treatment on the outer layer of a laminate to provide a durable water repellent (DWR) treatment which helps to repel water droplets impinging on the outer layer. Water-resistant fabrics may also be used, such as for the outer material layer. As used herein "water-resistant fabric" is a fabric that is substantially impervious to water. In some examples, the term "water-resistant fabric" may be defined as a fabric that has greater than 1,000 mm of water resistance, which is the amount of water, in mm, which can be suspended above the fabric before water seeps through. However, values above and below this threshold may also be used. A "weather-resistant fabric" may also be utilized as one or more of the material layers. As used herein "weather-resistant fabric" is a fabric that is generally resistant to water and/or wind. In some instances, a weather-resistant fabric may comprise a fabric that is substantially impervious to water and exhibits a low rate of moisture vapor transmission. The moisture vapor transmission rate is the rate at which water vapor transfers through a given substance.

While the jackets discussed above primarily contemplate the use of a lightweight inelastic fabric, it is also contemplated herein that heavier inelastic fabrics, such as fabrics with weights in the range of 90 g/m$^2$ to 149 g/m$^2$ or even 150 g/m$^2$ to 250 g/m$^2$ or higher may be used for jackets or garments with different applications where additional weight or durability may be desired. The fabrics, such as the fabric forming the outer layer, may be treated with waterproofing and down proofing chemicals such as for example, DWR chemical. Since cold weather garments may be down or synthetic thermal fiber filled, an upside of these treatments, is that they prevent the fill from poking through the fabric and, they prevent water moisture from the environment from entering inside of the garment. A downside of these chemical treatments on fabrics, is that these treatments may create a barrier preventing moisture generated from perspiration to evaporate when the vented cold weather garment is in an as-worn configuration.

As some more specific examples, for some applications, the jacket or garment may have good resistance to water penetration as measured according to Test Method: JIS L1092:2009, Section 7.1.2—Method B—high hydrostatic pressure test. That is, in examples where the jacket or garment is for a rain or snow application, substantial amounts of water do not permeate from outside of the jacket or garment to the inside of the jacket. For example, the jacket or garment may have greater than 10,000 mm water resistance; greater than 20,000 mm; and even greater than 30,000 mm. In one example, the jacket or garment may have water resistance in the range of about 10,000 mm to about 40,000 mm. For instance, the jacket or garment can have water resistance in the range of about 15,000 mm to about 35,000 mm. In another example, the jacket or garment may have a water resistance in the range of about 21,000 mm to about 31,000 mm and in some examples 28,000 mm to about 30,000 mm.

In some applications, the jacket or garment may be manufactured to also, or alternatively, have good moisture-wicking properties as measured according to Test Method: JIS L1092:2012, Method B-1—potassium acetate method. Water vapor is wicked away from the inside of the jacket or garment to outside of the jacket or garment and may be referred to as water vapor permeability. In some examples, and depending on the application, the jacket or garment may have a water vapor permeability of greater than 8,000 $g/m^2/24$ hr.; greater than 10,000 $g/m^2/24$ hr.; and/or greater than 15,000 $g/m^2/24$ hr. In some applications, the jacket or garment may have water vapor permeability in the range of about 8,000 to about 20,000 $g/m^2/24$ hr. For example, the jacket or garment can have water protection in the range of about 10,000 to about 18,000 $g/m^2/24$ hr. In another example, the jacket or garment has water protection in the range of about 12,000 to about 15,000 $g/m^2/24$ hr. and more specifically about 14,000 to about 15,000 $g/m^2/24$ hr. In some examples, the ratio of water resistance to water vapor permeability is about 1.00 to about 1.00 and preferably in the range of about 1.00:1.00 to about 5.00:1.00. In one example, the ratio of water resistance to water vapor permeability is about 2.00 to about 1.00. In another example, the ratio of water resistance to water vapor permeability is about 3.00 to about 1.00.

Figure 11:
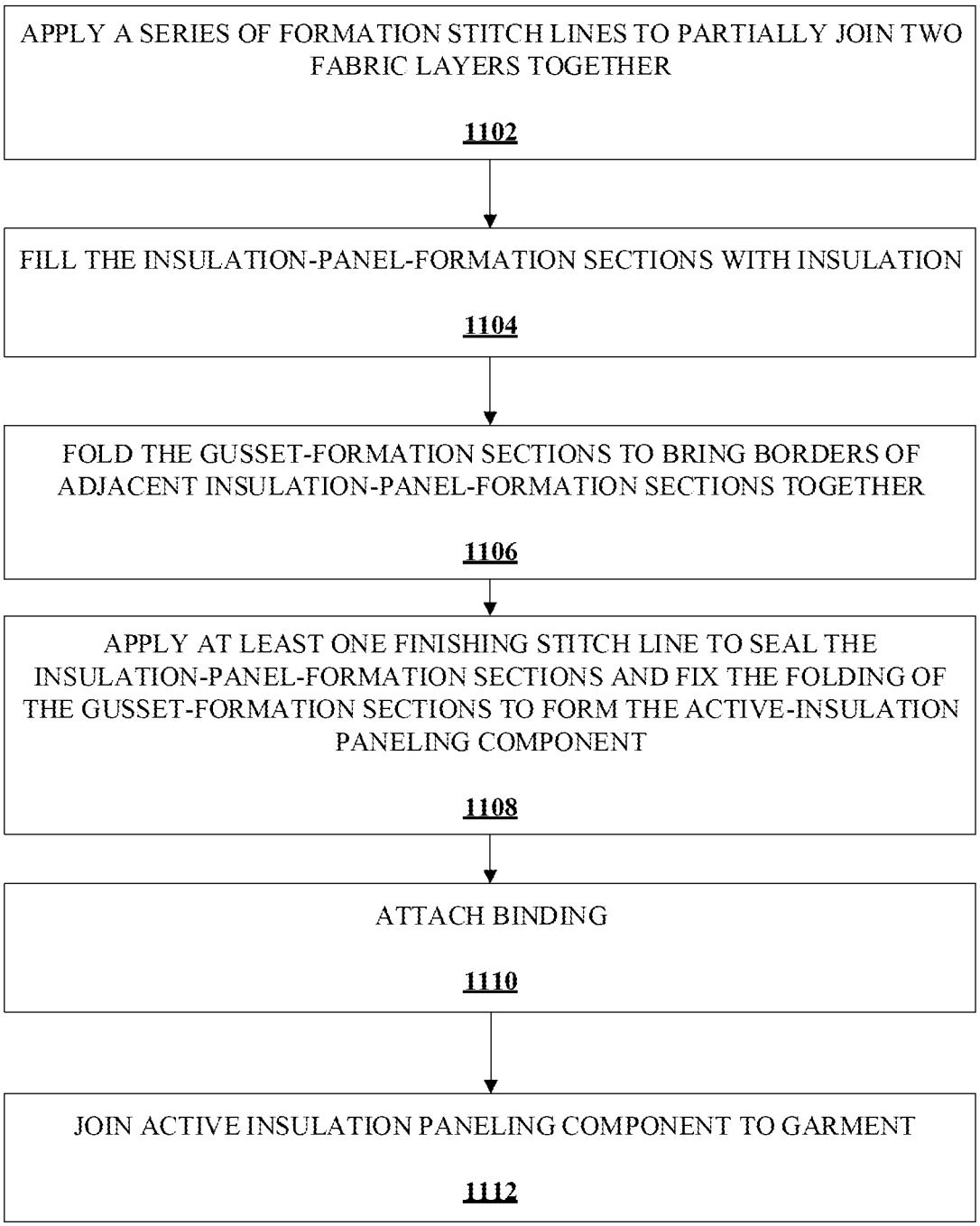
FIG. 11 depicts an example method for manufacturing an active-insulation paneling component.

FIG. 11 depicts an example method 1100 for manufacturing an example active-insulation paneling component. At operation 1102, a series of formation stitch lines are applied to partially join two fabric layers together. The formation stitch lines may be applied by stitching, sewing, or other joining techniques. The two fabric layers may include the first material layer 302 and the second material layer 304 discussed above. The formation stitch lines may include the formation stitch lines 306 discussed above. The formation stitch lines applied in operation 1102 define a series of insulation-panel-formation sections (e.g., Sections A in FIG. 3B) and gusset-formation sections (e.g., Sections B in FIG. 3B). For instance, the stitch lines may include border stitch lines that delineate the different types of sections. The formation stitch lines may also include a central stitch line in each of the gusset-formation sections. The series of insulation-panel-formation sections may form channels or tubes such that insulation may be added in between the two fabric layers.

At operation 1104, the insulation-panel-formation sections are filled with insulation. For instance, insulation is added between the two fabric layers. The insulation may be blown-in insulation that is blown into the tubes or channels formed by the insulation-panel-formation sections.

At operation 1106, the gusset-formation sections are folded to bring the borders of adjacent insulation-panel-formation sections together. For example, the gusset-formation sections may be folded along a central stitch line to bring the borders of the adjacent insulation-panel-formation sections together. The borders of the adjacent insulation-panel-formation sections may overlap one another. For example, a central insulation-panel-formation section may overlap the respective peripheral insulation-panel-formation section. In another example, the peripheral insulation-panel-formation section may overlap the respective central insulation-panel-formation section.

At operation 1108, after the folding operation 1106, one or more finishing stitch lines are applied. The finishing stitch lines may be the finishing stitch lines 318 discussed above. The finishing stitch lines may be substantially orthogonal to the formation stitch lines applied in operation 1102. For instance, the angle between one or more finishing stitch lines and one or more formation stitch lines may be 90 degrees plus or minus 45 degrees.

The finishing stitch lines may seal the insulation-panel-formation sections that have been filled with insulation. Sealing the insulation-panel-formation sections substantially prevents the insulation from falling out of the insulation panel-formation sections. The finishing stitch lines may also fix the folds, or folding, of the gusset-formation sections. For instance, the finishing stitch lines may provide stitches through the overlapping borders of the insulation-panel-formation sections that fixes the folds at the position (s) of the finishing stitch line(s). Application of the finishing stitch lines may result in an active-insulation paneling component.

At operation 1110, a binding may be attached or joined to the active-insulation paneling component. The binding may be attached around the periphery or perimeter of the active-insulation paneling component and/or on one or more sides of the paneling component, as discussed above.

At operation 1112, the active-insulation paneling component is joined, attached, or otherwise incorporated into, or to, a garment. For example, the active insulation paneling component may be joined to a jacket, pants, a glove, and/or shoe, among other types of garments that benefit from the combined expansion and insulation components of the active-insulation paneling components. As an example, the active-insulation paneling component may be joined to a back side of a torso portion of a jacket, such as the jackets described above. Joining the active-insulation paneling component may include attaching the active-insulation paneling component to the torso portion and/or the collar of the jacket, among other attachment configurations discussed herein.

Operation 1112 may also include attaching an elastic band to the active-insulation paneling component and/or the garment. The elastic band may be attached to one or more of the gussets of the active-insulation paneling component and to one or more locations on the garment, such as a sleeve seam. The elastic band may be attached via bar tacks or other attachment mechanisms.

Although specific devices and processes have been recited throughout the disclosure as performing specific functions, one of skill in the art will appreciate that these devices are provided for illustrative purposes, and other devices may be employed to perform the functionality disclosed herein without departing from the scope of the disclosure. In addition, some aspects of the present disclosure are described above with reference to block diagrams and/or operational illustrations of systems and methods according to aspects of this disclosure. The functions, operations, and/or acts noted in the blocks may occur out of the order that is shown in any respective flowchart. For example, two blocks shown in succession may in fact be executed or performed substantially concurrently or in reverse order, depending on the functionality and implementation involved.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art. Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A method of manufacturing an active-insulation paneling component for incorporation into a garment, the method comprising:

applying formation stitch lines to partially join two fabric layers together, wherein the formation stitch lines define insulation-panel-formation sections and gusset-formation sections located between the insulation-panel-formation sections, wherein each gusset-formation section is defined by at least two formation stitch lines;

filling the insulation-panel-formation sections with insulation;

folding the gusset-formation sections to bring borders of adjacent insulation-panel-formation sections together, the borders of the adjacent insulation-panel-formation sections defined by the formation stitch lines; and applying, substantially orthogonal to the formation stitch lines, at least one finishing stitch line to seal ends of the insulation-panel-formation sections and fix the folding of the gusset-formation sections to form the active-insulation paneling component, wherein the active-insulation paneling component is configured to expand when a pulling force is applied in a direction orthogonal to the formation stitch lines.

2. The method of claim 1, wherein the two fabric layers are made from an inelastic material having a weight less than or equal to 50 grams per square meter (gsm).

3. The method of claim 1, wherein the insulation is blown-in insulation.

4. The method of claim 1, wherein, prior to the step of folding the gusset-formation sections, the insulation-panel-formation sections have a width (D3), the gusset-formation sections have a width (D4), the widths D3 and D4 satisfy the inequality D3>2*D4.

5. The method of claim 4, wherein each gusset-formation section includes a central stitch line, and the step of folding the gusset-formation sections is performed along the central stitch line.

6. The method of claim 1, wherein folding the gusset-formation sections causes the borders of the adjacent insulation-panel-formation sections to partially overlap.

7. The method of claim 1, further comprising, joining the active-insulation paneling component to a jacket.

8. A method of manufacturing an active-insulation paneling component for incorporation into a garment, the method comprising:

applying formation stitch lines to partially join two fabric layers together, wherein the formation stitch lines include a first formation stitch line, a second formation stitch line, a third formation stitch line, and a fourth formation stitch line, wherein:

the first formation stitch line and the second formation stitch line define borders of a first insulation-panel-formation section;

the second formation stitch line and the third formation stitch line define borders of a gusset-formation section; and the third formation stitch line and the fourth formation stitch line define borders of a second insulation-panel-formation section;

filling the first and second insulation-panel-formation sections with insulation;

folding the gusset-formation section to bring the second formation stitch line and the third formation stitch line together; and applying, substantially orthogonal to the formation stitch lines, at least one finishing stitch line to seal ends of the insulation-panel-formation sections and fix the folding of the gusset-formation section to form the active-insulation paneling component, wherein the active-insulation paneling component is configured to expand when a pulling force is applied in a direction orthogonal to the formation stitch lines.

9. The method of claim 8, further comprising attaching a binding around a periphery of the active-insulation paneling component.

10. The method of claim 8, attaching the active-insulation paneling component to an upper back side of a jacket such that the formation stitch lines extend in a head-to-toe direction.

11. The method of claim 10, wherein the active-insulation paneling component is attached to a collar and a sleeve of the jacket.

12. The method of claim 8, wherein, prior to the step of folding the gusset-formation section, the first insulation-panel-formation section has a width (D3), the gusset-formation section has a width (D4), the widths D3 and D4 satisfy the inequality D3>2*D4.

13. The method of claim 12, wherein the widths D3 and D4 satisfy the inequality 0.1*D3<D4.

14. The method of claim 12, wherein:

prior to the step of folding the gusset-formation section, the active-insulation paneling component has a width D1 and a length D2;

the width D4 is less than one third of the width D1; and the formation stitch lines extend at least 90% of the width D1.

15. The method of claim 8, wherein:

the gusset-formation section is a first gusset-formation section;

the formation stitch lines further include a fifth formation stitch line; and the fifth formation stitch line and the fourth formation stitch line define a second gusset-formation section.

16. A method of manufacturing a jacket with an active-insulation paneling component, the method comprising:

applying formation stitch lines to partially join two fabric layers together, wherein the formation stitch lines include a first formation stitch line, a second formation stitch line, a third formation stitch line, and a fourth formation stitch line, wherein:

the first formation stitch line and the second formation stitch line define borders of a first insulation-panel-formation section;

the second formation stitch line and the third formation stitch line define borders of a gusset-formation section; and the third formation stitch line and the fourth formation stitch line define borders of a second insulation-panel-formation section;

filling the first and second insulation-panel-formation sections with insulation;

folding the gusset-formation section to bring the second formation stitch line and the third formation stitch line together;

applying, substantially orthogonal to the formation stitch lines, at least one finishing stitch line to seal ends of the insulation-panel-formation sections and fix the folding of the gusset-formation section to form the active-insulation paneling component, wherein the active-insulation paneling component is configured to expand when a pulling force is applied in a direction orthogonal to the formation stitch lines; and attaching the active-insulation paneling component to an upper back side of a jacket such that the formation stitch lines extend in a head-to-toe direction.

17. The method of claim 16, wherein the active-insulation paneling component is attached to a collar of the jacket.

18. The method of claim 17, wherein the active-insulation paneling component is attached to a sleeve of the jacket.

19. The method of claim 16, wherein the active-insulation paneling component is attached to an insulated segment on the lower back of the jacket, the insulated segment extending laterally.

20. The method of claim 16, further comprising attaching a lateral-extending elastic band to the gusset-formation section, wherein the elastic band is configured to stretch when the pulling force is applied in the direction orthogonal to the formation stitch lines.

* * * * *